United States Patent [19]

Kupersmit

[11] Patent Number: 4,705,162

[45] Date of Patent: Nov. 10, 1987

[54] MULTIPLE DISPLAY CARTON SHIPPING PACKAGE

[76] Inventor: Julius B. Kupersmit, 299 W. 12th St., New York, N.Y. 10011

[21] Appl. No.: 929,800

[22] Filed: Nov. 13, 1986

[51] Int. Cl.[4] ..... B65D 1/22

[52] U.S. Cl. ..... 206/45.11; 206/44 R; 206/44.11; 206/45.13; 206/386

[58] Field of Search ..... 206/44, 44 B, 44 K, 206/44.11, 44.12, 45, 45.11, 45.12, 45.13, 45.14, 386

[56] References Cited

U.S. PATENT DOCUMENTS

| | | | |
|---|---|---|---|
| 611,063 | 9/1898 | Davis | 206/45.11 |
| 2,173,917 | 9/1939 | Ryan | 206/45.11 X |
| 2,489,054 | 11/1949 | Sprolle | 206/386 |
| 2,735,553 | 2/1956 | Lehman | 206/44.12 X |
| 3,190,439 | 6/1965 | Parker | 206/45 |
| 3,659,707 | 5/1972 | Nilsson et al. | 206/44.12 X |
| 3,664,494 | 5/1972 | Mergens | 206/44 R |
| 4,042,127 | 8/1977 | Brossia | 206/386 X |
| 4,153,161 | 5/1979 | Taylor et al. | 206/386 |
| 4,262,837 | 4/1981 | Fremion | 229/52 B X |
| 4,567,981 | 2/1986 | Headon | 206/45.14 |

FOREIGN PATENT DOCUMENTS

| | | | |
|---|---|---|---|
| 1097410 | 7/1955 | France | 206/44.11 |

*Primary Examiner*—Stephen Marcus
*Assistant Examiner*—Michael J. Shea
*Attorney, Agent, or Firm*—Charles E. Temko

[57] ABSTRACT

A multiple merchandise display shipping package and method of assembly is disclosed. The package consists of plural displays in a tray base to which a two-tab slip sheet is bonded. A T-shaped paper board section is placed upright between the displays and locks them together by means of a wing type cover for damage free handling. When the package arrives at a breakbulk location, the T-section is removed, and the individual displays are transported to a point of sale location.

5 Claims, 9 Drawing Figures

FIG. 5
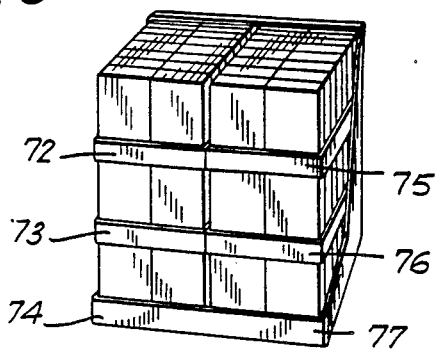
FIG. 6
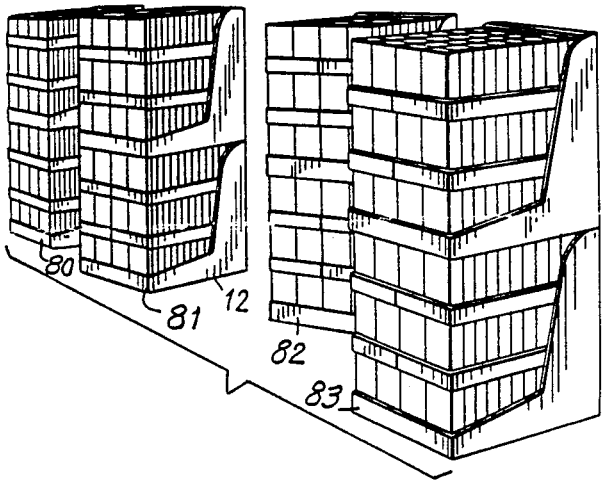
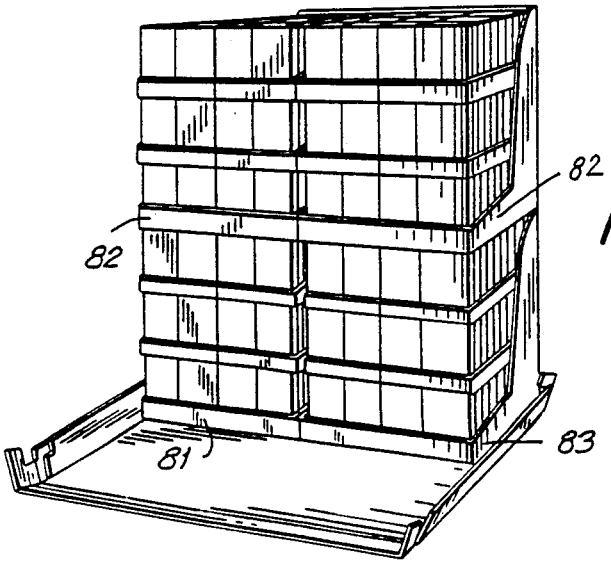
FIG. 7

MULTIPLE DISPLAY CARTON SHIPPING PACKAGE

BACKGROUND OF THE INVENTION

This invention relates generally to the field of material handling, and more particularly to an improved construction for assembling plural merchandise display units into a common package for shipping and handling to be disassembled to form individual displays at a point of consignment.

Many small items of merchandise are most conveniently handled by assembling plural packaged items upon a cardboard or corrugated display structure which can be conveniently moved to point of purchase in a retail establishment. Such display units are normally too small to be shipped individually, and the assembly of such units into a larger container, absent means holding the individual items in a display is, at best, difficult, and wasteful, unless the outer container can be collapsed and subsequently reused, which is not often the case. On the other hand, the assembly of the display at the retail level is not economic from the standpoint of time of sales personnel, and adds significantly to the cost of doing business.

SUMMARY OF THE INVENTION

Briefly stated, the invention contemplates the provision of a novel packaging concept which enables the creation and assembly of individual merchandise displays of sizes suitable, for example, for end of aisle positioning, the subsequent assembly of plural display units into a common package without the necessity of providing a large enclosed container, and using a T-shaped reinforcement which is positioned internally of the outer surfaces of the package which sufficiently encloses the individual displays for protection during stacking and shipping. Upon arrival at the destination, the package is conveniently opened for disassembly into individual disply units for removal to a chosen point of sale location. The package includes four component structures, including a plurality of package trays, each capable of holding several dozen individual items of boxed merchandise. A prime module accommodates plural loaded trays in side-by-side relation. A box base having latchable corners and a bonded on slip sheet accommodates four prime modules. A vertical divider of paper board fits between the prime modules at the center of the box base, and by means of pivotally mounted upper flaps, locks all of the modules together at the top. Where desired, a stretch film wrap covers the exposed individual merchandise packages.

BRIEF DESCRIPTION OF THE DRAWINGS

In the drawings, to which reference will be made in the specification, similar reference characters have been employed to designate corresponding parts throughout the several views.

FIG. 5 is a view in perspective showing the assembly of plural displays within a prime module.

FIG. 6 is a view in perspective showing the stacking of plural prime modules prior to further assembly.

FIG. 7 is a view in perspective showing the positioning of the structure shown in FIG. 6 upon a base element.

DETAILED DESCRIPTION OF THE DISCLOSED EMBODIMENT

Figure 1:
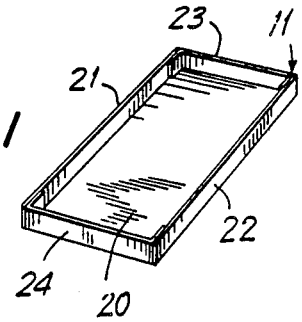
FIG. 1 is a view in perspective showing a package tray forming a part of the disclosed embodiment.

In accordance with the invention, the device, generally indicated by reference character 10, comprises broadly: a plurality of package trays 11, a plurality of prime modules 12, a single T-box section 13, and a single tray base element 14.

The package trays 11 constitute shallow open boxes, each including a bottom wall 20, peripheral side walls 21 and 22 and peripheral end walls 23 and 24. They are most conveniently formed of single ply corrugated paper.

Figure 2:
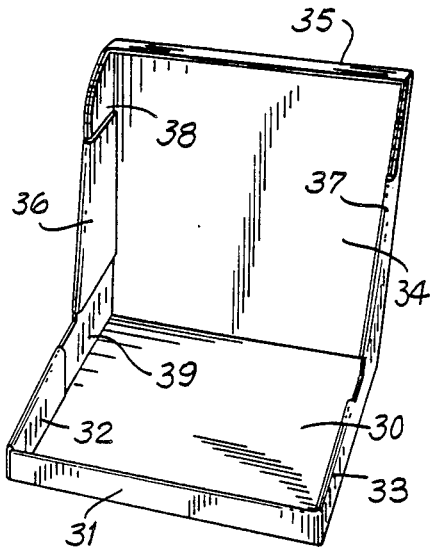
FIG. 2 is a view in perspective showing a prime module forming a second part of the disclosed embodiment.

The prime modules 12 are constructed using somewhat heavier corrugated paper stock, and ultimately form the point of purchase display enclosure. As best seen in FIG. 2 in the drawing, each includes a rectangular bottom wall 30, a single vertical end wall 31, first and second side walls 32 and 33, a rear wall 34, an abbreviated upper wall 35, and triangular side walls 36 and 37. Upper and lower glue flaps 38 and 39 interconnect the walls 33–37 for rigidity.

Figure 3:
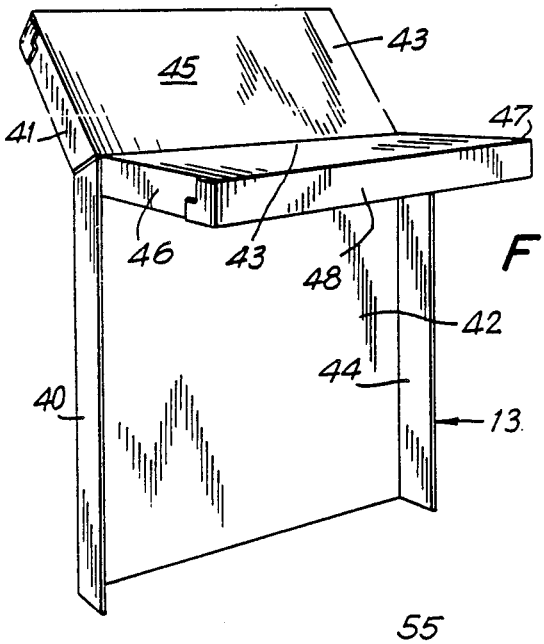
FIG. 3 is a view in perspective of a T-box section forming a third part of the disclosed embodiment.

The T-box section 13 (FIG. 3) comprises first and second integrated parts 40 and 41 each including a vertical wall 42 glued to the wall of the other part, each including a top flap or cover 43 and stiffening vertical flanges 44. The flap or cover 43 includes a main horizontal wall 45, a pair of peripheral side walls 46 and 47 and a single pheripheral end wall 48 (See FIG. 8).

Figure 4:
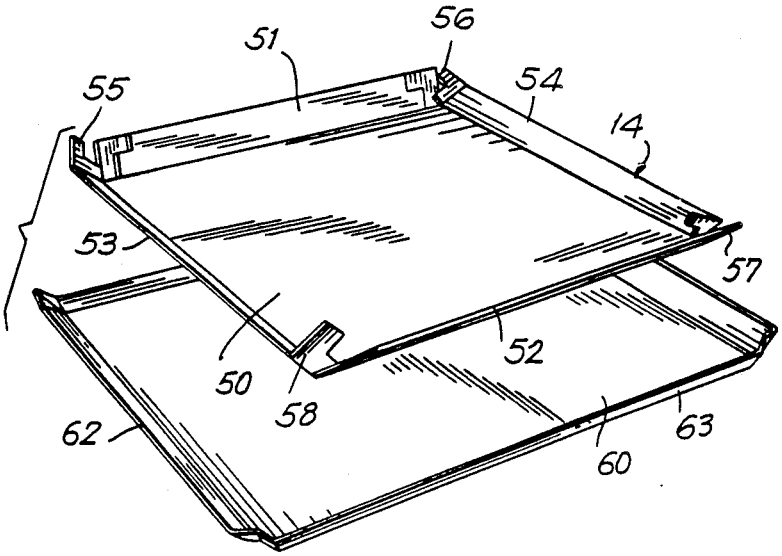
FIG. 4 is an exploded view in perspective showing a base element forming a fourth part of the disclosed embodiment.

The tray base element 14 (FIG. 4) includes a main horizontal wall 50, a pair of side walls 51 and 52, and a pair of end walls 53 and 54. Four latched corners 55, 56, 57 and 58 permit the element 14 to receive prime modules during the loading procedure, the corners being subseuqntly interconnected to assist in maintaining the modules in position.

Disposed beneath the wall 50 is a conventional bonded slip sheet 60, including a main wall 61, an end flap 62 and a side flap 63 which facilitate engagement of an assembled device by a fork lift truck or similar loading device (not shown).

Assembly of the device 10 will be appreciated from a consideration of the drawing. To begin, the packaged trays 11 are loaded with a plurality of individual merchandise packages 70 to form six loaded trays 72, 73, 74, 75, 76 and 77. These are subsequently loaded in juxtaposed and stacked relation as seen in FIG. 5 to fully load an individual prime module. FIG. 6 shows four modules 80, 81, 82, and 83 in double stack relation ready for loading upon the base element 14. FIG. 7 shows the same modules positioned at one end of the base element 14 with the open sides thereof facing inwardly.

Figure 8:
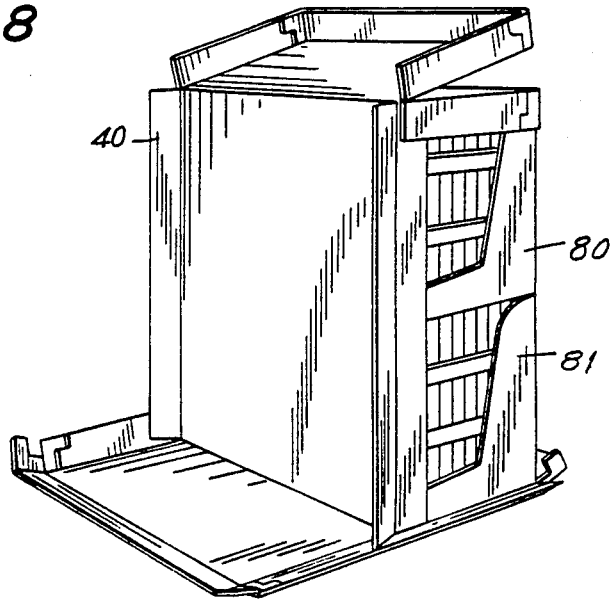
FIG. 8 is a view in perspective showing the subsequent positioning of a T-box section.
Figure 9:
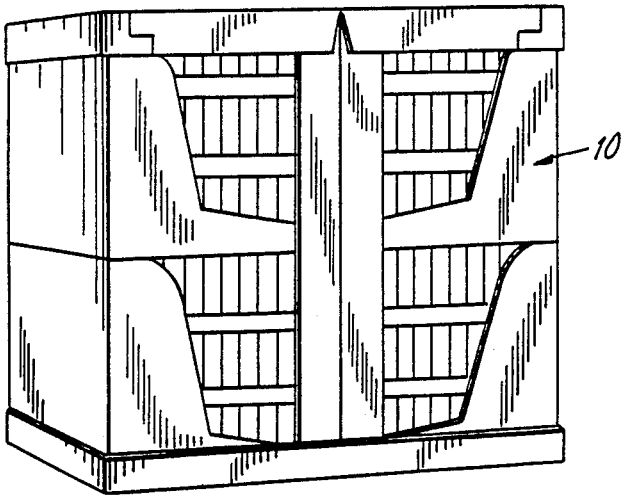
FIG. 9 is a view in perspective showing a fully assembled package ready for shipping.

FIG. 8 shows the positioning of the T-box section alongside and over the modules 80–83, with one of the flaps positioned over the uppermost surface of the uppermost module. FIG. 9 shows an additional set of four modules placed on the tray base element 14 in a similar manner and the remaining flap positioned to form a complete enclosure. The corners 55–59 can then be interconnected to form a similar function at the bottom of the package.

Optionally, the entire package may than be wrapped with a stretch film to prevent any soiling of the exposed merchandise packages, and the device 10 may then be shipped to its point of consignment. Upon arrival, disassembly is accomplished by the reverse of the above-described operation, except that once the individual prime modules are freed, they can be wheeled using a hand truck to a point of purchase within a retail establishment. Where desired, the T-box section 13 and base element 14, if undamaged, may be collected for return shipment to be reused, thus effecting a degree of economy.

It will be observed that substantially all of the preparation of the displays can be performed at the point of shipment, rather than at the retail establishment, with corresponding economies in utilization of personnel. Because a complete box-like enclosure is not required, the savings in packaging costs of materials is also substantial. Because of the presence of the T-box section 13, it is possible to stack plural devices 10 without damage to any part of the underlying devices or their contents.

I wish it to be understood that I do not consider the invention to be limited to the precise details of structure shown and set forth in this specification, for obvious modifications will occur to those skilled in the art to which the invention pertains:

I claim:

1. An improved display carton shipping package comprising: a plurality of generally rectangular package trays, each having plural rectangular packages of items of merchandise in juxtaposed relation thereon; a plurality of prime modules, said package trays and rectangular packages thereon being positioned in juxtaposed relation within said prime modules, each of said prime modules including a bottom wall, a single vertical end wall, a pair of partial side walls, and a partial top wall; a single T-box section formed of first and second symmetrically arranged elements, each element including a vertical wall having upper and lower edges, and a pair of horizontal flaps forming top walls, each hingedly connected at said vertical wall at an upper edge, and having a peripheral rim at the free edges thereof; a single tray base element having a bottom wall and a selectively interconnectable peripheral rim; said package being assembled by loading plural package trays with items of rectangularly packaged merchandise, placing said loaded trays in adjacent and stacked relation to fill a plurality of prime modules; placing a first plurality of loaded modules upon said base element adjacent one end thereof, positioning said T-box section such that said lower edge of said vertical wall thereof contacts a medial transversely extending area of the upper surface of said bottom wall of said base element, positioning a second plurality of loaded modules upon said base element on an opposite side of said vertical wall of said T-box section, positioning said horizontal flaps of said T-box section upon the uppermost surfaces of said modules wherein said peripheral rim thereof engages the upper exposed portions of each of said modules, and interconnecting said peripheral rim of said base element to engage the exposed lower portions of said modules to form an integral package.

2. An improved shipping package as set forth in claim 1, further characterized in said base element having an integral slip sheet on a lower surface thereof.

3. An improved shipping package as set forth in claim 1, further comprising a stretch film wrap enclosing the exposed surfaces thereof.

4. An improved shipping package in accordance with claim 1, further characterized in said package being assembled such that said modules are positioned with the vertical end walls thereof facing outwardly.

5. An improved shipping package in accordance with claim 1 further characterized in said T-box section vertical wall includes a pair of laminated plies, with a flap foldably connected at the upper edge of each of said plies.

* * * * *